US006101903A

United States Patent [19]

Negley et al.

[11] Patent Number: 6,101,903

[45] Date of Patent: Aug. 15, 2000

[54] STRAP WRENCH

[75] Inventors: Marvin C. Negley; Scotty R. Kurtz, both of Clarinda, Iowa

[73] Assignee: Lisle Corporation, Clarinda, Iowa

[21] Appl. No.: 09/282,470

[22] Filed: Mar. 31, 1999

[51] Int. Cl.[7] ..... B25B 13/52

[52] U.S. Cl. ..... 81/64; 81/3.43

[58] Field of Search ..... 81/64, 3.43

[56] References Cited

U.S. PATENT DOCUMENTS

| | | | |
|---|---|---|---|
| D. 369,076 | 4/1996 | Alexander . | |
| 840,496 | 1/1907 | Justen | 81/64 |
| 1,196,479 | 8/1916 | Phelps | 81/3.43 |
| 1,294,515 | 2/1919 | Monahan | 81/64 |
| 1,422,302 | 7/1922 | Parker | 81/64 |
| 1,646,661 | 10/1927 | Richard | 81/64 |
| 1,662,413 | 3/1928 | Bright . | |
| 1,774,201 | 8/1930 | Jenkins . | |
| 2,081,383 | 5/1937 | Rector . | |
| 2,128,991 | 9/1938 | Eighmey | 81/64 |
| 4,145,938 | 3/1979 | Laird, Jr. | 81/64 |
| 5,323,671 | 6/1994 | Hebert | 81/64 |

OTHER PUBLICATIONS

Lisle Corporation 1997 catalog, pp. 12, 24, 25, 26, and 27.

*Primary Examiner*—David A. Scherbel
*Assistant Examiner*—Joni B. Danganan
*Attorney, Agent, or Firm*—Banner & Witcoff, Ltd.

[57] ABSTRACT

A strap wrench includes a molded plastic handle with teeth molded into the handle to engage the outside surface of a flexible strap which includes an elastomeric layer of material.

7 Claims, 2 Drawing Sheets

FIG.3
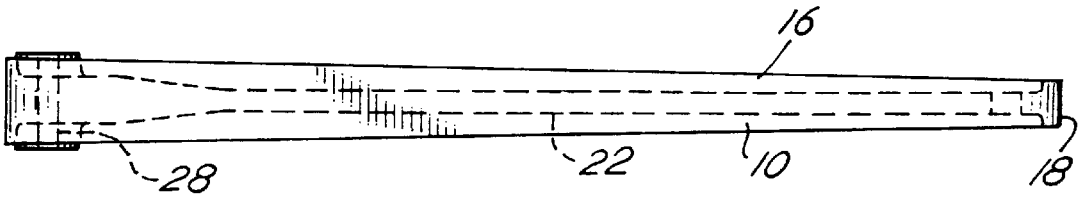
FIG.4
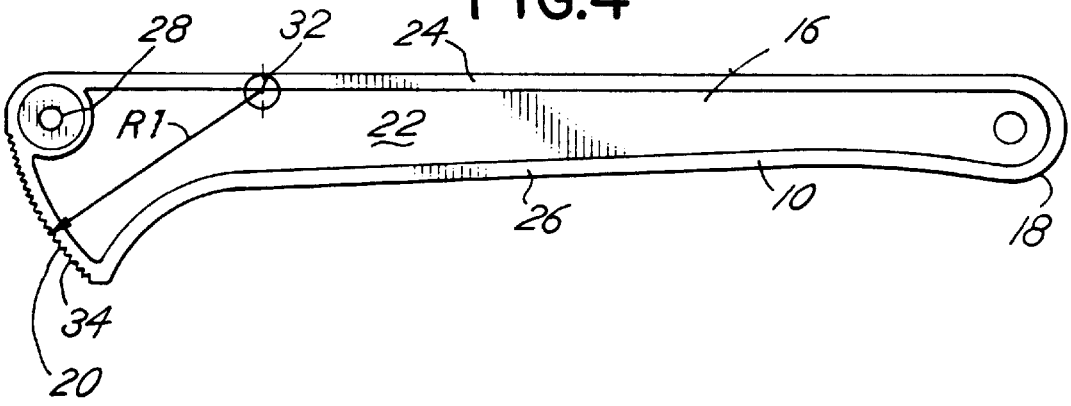
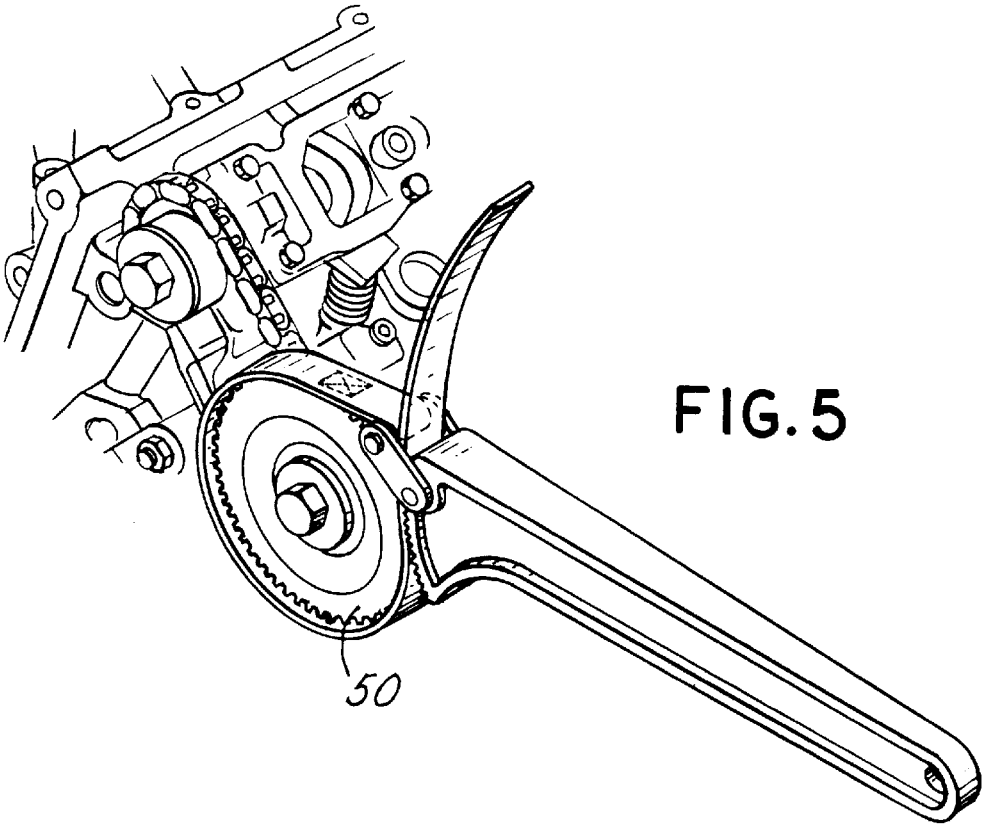
FIG.5

STRAP WRENCH

BACKGROUND OF THE INVENTION

This invention relates to a strap wrench, and more particularly, to a strap wrench having a strap coated with an elastomeric layer in combination with a handle that has serrations, teeth or other gripping means for co-action or cooperation with the strap.

Heretofore, strap wrenches have been used, for example, in the automobile repair industry to rotate various engine components. Typically, a strap wrench includes a carrier handle with a flexible strap attached to one end of the handle. The free end of the flexible strap fits through an opening in the handle or an opening through a bracket attached to the handle to thereby fully encircle the item being gripped. Manual force on the handle will apply torque to the item to rotate the item, for example, a cam shaft sprocket. Devices of this general nature have been utilized for some time, particularly in the automobile repair industry and also for other purposes and in other industries, see for example, U.S. Pat. No. 4,145,938.

Nonetheless, there has remained a need for an improved strap wrench to provide enhanced gripping capability, particularly in situations where the strap associated with the wrench might slip and become disengaged from the carrier handle or might slip on the item which is to be manipulated by the strap wrench. Such needs inspired the development of the present invention.

SUMMARY OF THE INVENTION

Briefly, the present invention comprises a strap wrench which includes an elongate strap attached at one end to a carrier handle. The one end of the handle to which the strap is attached also includes an array of teeth for gripping a free end of the strap. A bracket is thus affixed to the strap engaging end of the handle. The bracket includes a strap mounting member to which the first end of the strap is permanently attached. The strap mounting member is spaced from the strap engaging end of the handle to permit insertion of the second or free end of the strap in the gap between the mounting member and handle. The second end of the strap thus fits through the opening between the bracket and the handle so that the strap surrounds the item to be gripped. The outside surface of the strap may be engaged by the teeth on the carrier handle to hold the strap. The teeth firmly grip the strap thereby providing non-slip engagement with the strap. Preferably the surface of the strap, which is engaged by the teeth, includes a layer of elastomeric material such as rubber, preferably having a durometer hardness in the range of 60 to 90.

Thus, it is an object of the invention to provide an improved strap wrench.

A further object of the invention is to provide an improved strap wrench which utilizes a handle having a strap engaging surface with teeth configured to effectively grip the strap.

Yet another object of the invention is to provide a strap wrench wherein a strap is provided having one surface that includes elastomeric material to facilitate gripping of the strap tightly about an item which is to be torqued or turned.

Yet another object of the invention is to provide an improved strap wrench which is easy to manufacture, rugged, and not expensive.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 3 is a top plan view of the handle of the strap wrench;

FIG. 4 is a side elevation of the handle of the strap wrench; and

FIG. 5 is an isometric view of the strap wrench of the invention illustrating the manner of use.

DESCRIPTION OF THE PREFERRED EMBODIMENT

Figure 1:
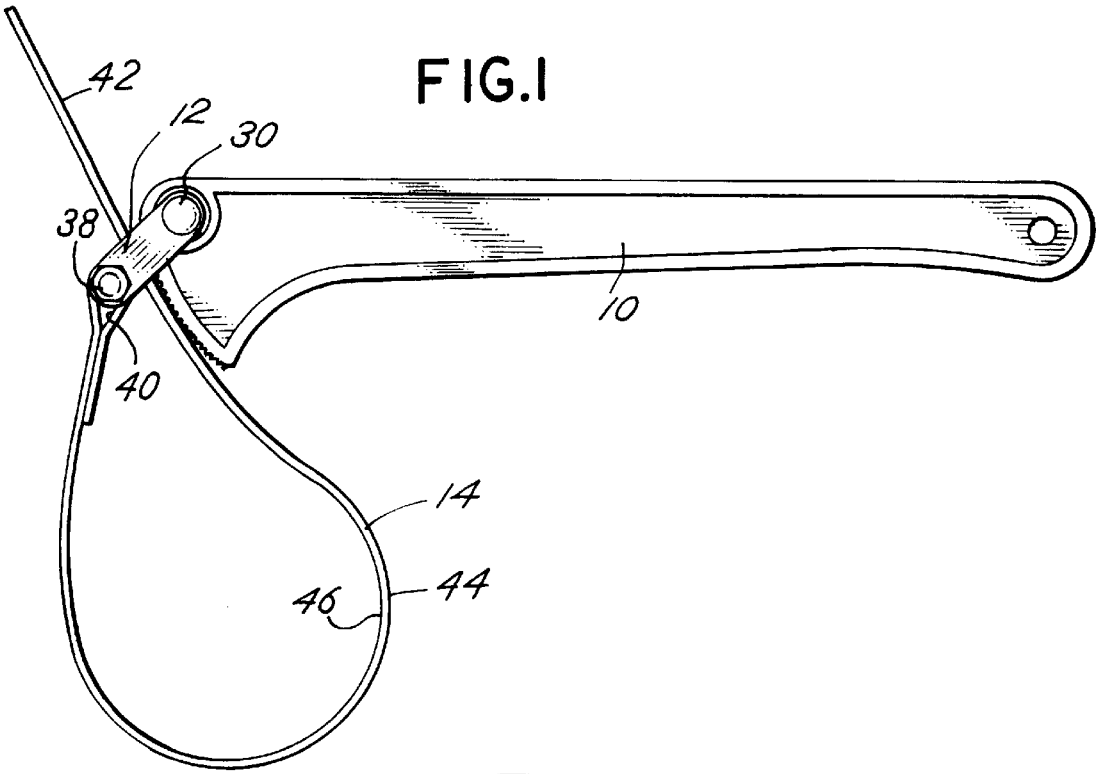
FIG. 1 is a side elevation of the strap wrench of the invention wherein the strap is positioned for engagement by the handle.
Figure 2:
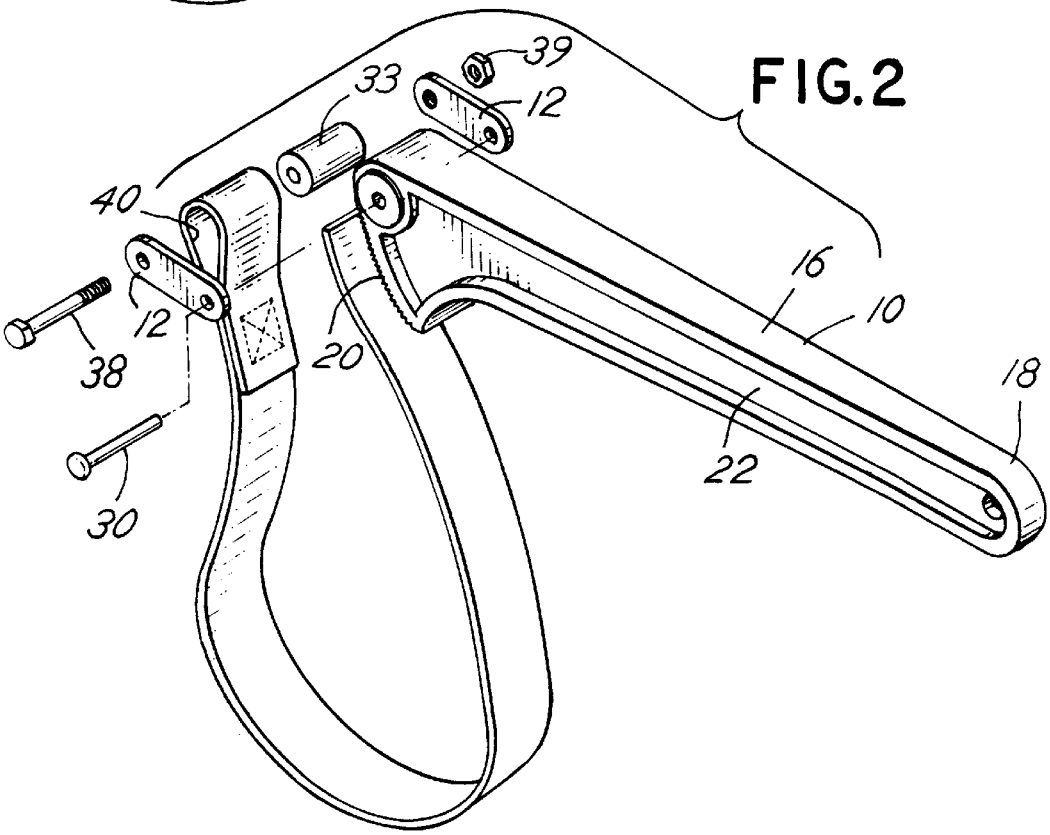
FIG. 2 is an exploded side elevation of the strap wrench of FIG. 1.

Referring to the figures, the strap wrench includes a handle 10, a bracket 12 and a flexible strap 14. The handle 10 includes an elongate gripping section 16 which extends from an outer end 18 to a gripping end 20. In the preferred embodiment, the handle 10 has a configuration in cross section of an I-beam with a center web 22, an upper cross element 24 and a lower cross element 26. This particular configuration imparts additional strength to the handle 10.

The gripping end 20 of the handle 10 includes a through passage 28 for receipt of a pin or rivet 30 which attaches the bracket 12 to the handle 10. The length of the through passage 28 is dimensionally equal to the width of the handle 10, and more particularly, the width of the cross bar element 24 at the gripping end 20.

The passage 28 is positioned generally adjacent to or in the cross bar element 24. The cross bar element 24 defines a generally planar straight line member extending from the outer end 18 to the strap engaging end 20. Thus the strap engaging end 20 extends downwardly from element 24 in FIG. 4 and forms an arc with a center 32 and radius $R_1$. Center 32 is located on the element 24. The radius $R_1$ of the arc is typically in the range of 2–3 inches but may be varied according to needs and size of the strap wrench. Also, the extent of the radius $R_1$ of the arc from the center 32 to the strap engaging end 20 is in the range of one-eighth to one-fourth of the length of the handle 16. The length of the arc of the strap engaging end 20 is approximately equal to the arc radius $R_1$ and may vary therefrom by plus or minus 50 to 75%. In the preferred embodiment, the length of the arc is approximately equal to the radius $R_1$ of the arc.

The outside surface of the strap engaging end is comprised of a series of serrations or teeth or ribs 34 which are generally parallel to the axis of passage 28 and are arrayed along the length of the strap engaging end 20. Typically the angle of inclination of each one of the teeth 34 is in the range of about 60° but any desired tooth configuration may be used. Additionally, in place of elongate, parallel teeth 34 extending over the surface of the arcuate strap engaging end 20, parallel to the center line axis of the passage 28, other rib shapes or tooth shapes may be utilized. Thus, the particular configuration of the teeth 34 is not necessarily a limiting feature of the invention. It is important, however, to have some type of gripping members such as the teeth 34.

The passage 28 receives a pin rivet 30 which holds first and second parallel bracket members 12 on the handle 10. The bracket members 12 extend outwardly from the pivot passageway 28 and terminate with a bolt 38 and cooperative nut 39 attached through openings in the ends of the brackets 12. A spacer bushing 33 for bracket 12 fits through a loop 40 defined in the first end of the strap 14 and receives the bolt 38. The strap 14 thus has a first end defined by the loop 40 and a second free end 42 which is fitted through the space defined between the loop 40 attached to the bolt 38 and the surface of the engaging end 20. The distance between the center of the passageway 28 and the center of bolt 38 is typically in the range of about one-quarter to one times the length of the radius $R_1$ of the arcuate surface 20, although other spacing may be utilized as desired or necessary based upon the utilization requirements of the strap wrench. Additionally, the length of the handle 10, and more particularly the distance between the ends 18 and 20, is at least about five times greater than the distance between the center line of passageway 28 and the center line of bolt 38.

As an important feature of the invention, the strap 14 includes an elastomeric coating on an outside surface 44. The elastomeric coating preferably has a durometer hardness in the range of 60 to 90 durometer and comprises preferably at least about 5% of the thickness of the strap 14 (or in the range of 5% to about 35%). Inside surface 46 may also include an elastomeric layer or coating which will facilitate gripping of an item such as item 50 in FIG. 5. The strap 14 is typically made from a fabric material which is stitched at one end to form a loop 40 which fits around the bolt 38 and spacer 33. Typically the thickness of the outside elastomeric material on the outside 44 of the strap 14 is greater than the thickness of material on the inside surface 46.

The use of a rubber or elastomeric coating on the outside surface 44 of the strap 14 also prevents the teeth 34 from frictionally engaging and tearing reinforcing cords which are typically used in a fabric strap of the type depicted. Thus the rubber coating or elastomeric coating provides a multiplicity of functions including protection of the reinforcing cords and enhancement of the gripping action between the teeth 34 and the strap 14. The teeth 34 engage with and tightly grip the strap 14. This is an important feature of the tool inasmuch as when force is applied to the handle 10 in order to apply torque to an item, the teeth 34 will tightly grip the outside surface 44 of the strap 14 which tightens the strap around the item to be turned. The strap wrench thus becomes significantly more effective and useful.

In the preferred mode of use of the tool of the invention, the first end loop 40 is placed over the bolt 38 and spacer or bushing 33 and the second end 42 is fitted through the space defined by the bracket 12 between the bolt 38 and the engaging end 20. The strap 14 is then drawn tightly about item 50. Next, the handle 10 is manually manipulated to engage teeth 34 with strap 14 and ultimately tighten the strap 14 on item 50 to effect turning of the item 50.

Variations of the construction may be utilized. For example, the size, dimension, shape and configuration of the teeth 34 may be varied. The length of the arcuate gripping end 20 may be varied and teeth may be used along various portions and parts thereof. The radius $R_1$ of the arcuate section 20 may be varied. The material forming the strap 14 as well as the dimensional aspects of the strap and the other component parts of the strap wrench may be varied without departing from the scope and spirit of the invention. There are other features which may also be varied. Thus the invention is to be limited only the following claims and the equivalents thereof.

What is claimed is:

1. A strap wrench comprising, in combination:

a handle including an elongate gripping section and a strap engaging end, said strap engaging end including a strap engaging surface;

a bracket pivotally attached to the strap engaging end, said bracket projecting outwardly from the strap engaging end, said bracket including a strap mounting member spaced from the strap engaging end; and a flexible elongate strap having first and second ends, the first end attached to the strap mounting member and the second end being free for insertion through the bracket between the strap engaging end of the handle and the strap mounting member, said strap opposed to and engageable with the strap engaging surface to hold the strap in a fixed position relative to the strap engaging surface whereby the strap may be fitted around an item and inserted through the bracket, and said handle may then be manipulated to apply torque to said item, said strap comprising an elongate strip having an inside surface and an outside surface, said outside surface comprising an elastomeric layer having a thickness in the range of about 5% to about 35% of the thickness of the strap and engageable by the strap engaging surface.

2. A strap wrench comprising, in combination:

a handle including an elongate gripping section and a strap engaging end, said strap engaging end including teeth;

a bracket pivotally attached to the strap engaging end, said bracket projecting outwardly from the strap engaging end, said bracket including a strap mounting member spaced from the strap engaging end; and a flexible elongate strap having first and second ends, the first end attached to the strap mounting member and the second end being free for insertion through the bracket between the strap engaging end of the handle and the strap mounting member, said strap opposed to and engageable with the teeth to hold the strap in a fixed position relative to the teeth whereby the strap may be fitted around an item and inserted through the bracket, and said handle may then be manipulated to apply torque to said item, said strap comprising an elongate strip having an inside surface and an outside surface, said outside surface comprising an elastomeric layer having a thickness in the range of about 5% to about 35% of the thickness of the strap and engageable by the teeth.

3. The wrench of claims 1 or 2 wherein the handle includes a generally straight linear section for the gripping section with a pivot at the strap engaging end, said strap engaging end comprising a generally arcuate member extending from the pivot.

4. The wrench of claim 3 wherein the bracket has a length in the range of about ¼ to 1 times the radius of the generally arcuate gripping section.

5. The wrench of claim 2 wherein the elastomeric layer comprises an elastomer having a durometer hardness in the range of about 60–90.

6. The wrench of claim 2 wherein the inside surface of the strap includes an elastomeric material.

7. The wrench of claim 2 wherein the teeth comprise a series of spaced members generally parallel to an axis defined by the pivotal attachment of the bracket to the strap engaging end.

* * * * *